United States Patent [19]

Advokat

[11] 3,942,442

[45] Mar. 9, 1976

[54] NOVEL DUO-MATERIAL CASE FOR PYROTECHNIC FLARES

[75] Inventor: Theodor Advokat, Sydney, Australia

[73] Assignee: The United States of America as represented by the Secretary of the Army, Washington, D.C.

[22] Filed: June 28, 1974

[21] Appl. No.: 484,020

[52] U.S. Cl. ..... 102/37.8; 102/35

[51] Int. Cl.[2] ..... F42B 4/26

[58] Field of Search ..... 102/37.8, 35, 35.6, 31, 102/32; 149/43

[56] References Cited

UNITED STATES PATENTS

| | | | |
|---|---|---|---|
| 23,529 | 4/1859 | Lilliendahl | 102/37.8 |
| 1,530,692 | 3/1925 | Paulus | 102/37.8 |
| 2,864,311 | 12/1958 | Loedding | 102/37.8 |
| 2,968,542 | 1/1961 | Brock | 149/43 |
| 3,411,963 | 11/1968 | Douda | 149/43 |
| 3,411,964 | 11/1968 | Douda | 149/43 |
| 3,464,869 | 9/1969 | Wystrach et al. | 149/43 |
| 3,680,483 | 8/1972 | Staudacher et al. | 102/37.8 |

OTHER PUBLICATIONS

Military Explosives, April 1955, pp. 284 and 286.

*Primary Examiner*—Charles T. Jordan
*Attorney, Agent, or Firm*—Nathan Edelberg; Robert P. Gibson; A. Victor Erkkila

[57] ABSTRACT

Use of convolutely wound paper-metal foil laminate cases for pyrotechnic flare compositions comprising a metallic fuel and a solid inorganic oxidizer reduces "chimney" and flickering effects and increases the luminous efficiency of the flare, as compared with the use of conventional convolutely wound paper cases.

3 Claims, 3 Drawing Figures

NOVEL DUO-MATERIAL CASE FOR PYROTECHNIC FLARES

BACKGROUND OF THE INVENTION

The U.S. Army's standard 40 mm. XM 583 White Star Parachute Signal Flare employs a pyrotechnic flare composition comprising powdered magnesium fuel and sodium nitrate oxidizer contained in a case fabricated of convolutely wound kraft paper. A major deficiency of said flare is that it exhibits a "chimney" effect due to the failure of the case to burn as rapidly as the pyrotechnic composition contained therein, with the result that some of the light is obscured and the light efficiency is reduced. Also, flickering occurs as the flare burns through portions of the slower burning case, thereby exposing varying amounts of burning area.

SUMMARY OF THE INVENTION

An object of the present invention is to minimize or eliminate the deficiencies of prior art flares, wherein a convolutely wound paper case is used to contain a pyrotechnic composition comprising a powdered metal fuel, such as magnesium and aluminum, and a solid inorganic oxidizer, such as $NaNO_3$, $KNO_3$, $NH_4ClO_4$, $KClO_4$, as well as a binder.

According to the present invention the aforementioned deficiencies of said standard and other flares, which utilize a pyrotechnic composition comprising a metal fuel and an inorganic oxidizer, can be overcome by employing a novel duo-material flare case composed of convolutely wound paper laminated to a metal foil. By means of the present invention it is possible to reduce or eliminate the "chimney" and flickering effects as well as achieve a 20% or greater increase in luminous efficiency (candle-seconds/gram composition) of such flares, as compared with corresponding flares, wherein the same pyrotechnic composition is contained in the usual convolutely wound paper case.

DESCRIPTION OF THE PREFERRED EMBODIMENTS

Figure 1:
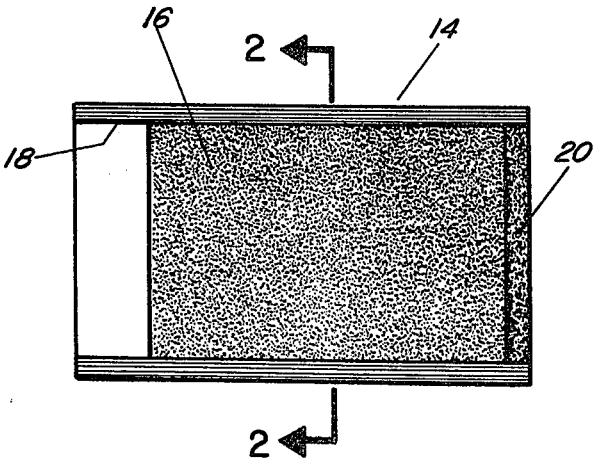
FIG. 1 shows a longitudinal sectional view of a novel flare case containing a flare composition.
Figure 2:
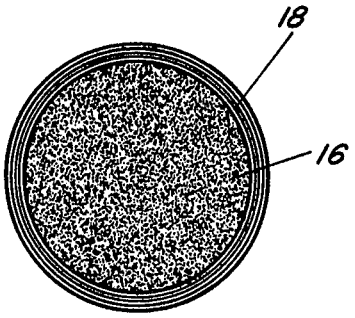
FIG. 2 is a cross-sectional view of the case of FIG. 1 along line 1—1.

Aluminum foil of 0.0007 in. thickness was bonded to one side of 60 lb. kraft paper (strong paper made from wood pulp prepared by the sulfate process) with a nitrocellulose base adhesive sold under the tradename DUCO cement, and the laminate thus obtained was convolutely wound on a mandrel with the same adhesive to form a tube 1.26 in. I.D. and 0.065 in. wall thickness, which was cut to 2.4 in. lengths, and shown in FIGS. 1 and 2.

In similar manner other flare cases were made using aluminum foils of 0.00035 in. and 0.0028 in. thickness, resp. Still other cases were similarly made except that aluminum foil of 0.00035 in. thickness was bonded to both sides of the kraft paper.

The pyrotechnic flare composition used consisted of 49% Mg atomized 30/50, 43% $NaNO_3$ and 8% binder (98.5% LAMINAC 4116, a proprietary product manufactured by American Cyanamid Co., consisting of a polyester with monomeric styrene that effects cross-linking on curing, 1% LUPERSOL DDM (methylethylketone in dimethylphthalate) and 0.5% cobalt naphthenate). The ingredients were mixed in a Lancaster countercurrent batch mixer under ambient conditions of temperature and humidity. The sodium nitrate was pre-dried at 110°C. and screened before blending into the composition. The liquid binder was added to the powdered magnesium and mixed for 5 minutes after which the sodium nitrate was added and the whole mixture was blended for 30 minutes.

Figure 3:
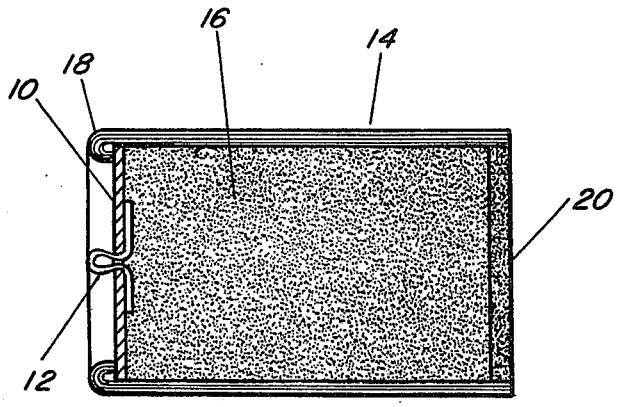
FIG. 3 is a longitudinal cross-sectional view of the loaded case provided with an aluminim disc closure at one end having an attachment for hanging.

The composition thus obtained was loaded into standard convolutely wound kraft paper cases and into the kraft paper-aluminum foil laminate cases prepared in the above manner under a loading pressure of 5 tons psi. As shown in FIG. 3, an aluminum disc closure 10 containing cotter pin 12 to facilitate hanging of the flare during testing, was inserted into one end of each flare 14 containing the pyrotechnic composition 16 and anchored thereto by crimping the case wall 18, and a standard igniter composition 20 was pressed into the opposite open end in contact with the flare composition.

The time-intensity characteristics of the flares were determined statically with the flares suspended vertically from a test stand burning face down. The tests were conducted in a pyrotechnic flare tunnel using a photocell-recordak combination.

Table I presents a comparison of the luminous efficiencies of the flares provided with the standard cases and the novel duo-material cases prepared in the foregoing manner.

Table 1

| Type of Paper | Al Foil Thickness (In.) | No. Test Items | Composition Wt. Grams | Candlepower $10^3$ Candles | Burning Time Seconds | Efficiency $10^3$ Candle Sec./Gm. |
|---|---|---|---|---|---|---|
| Kraft* | none | 5 | 78 | 73.4 | 39.0 | 36.6 |
| Kraft | 0.00035 | 4 | 70 | 81.8 | 29.5 | 34.4 |
| | 0.0007 | 5 | 75 | 110.1 | 30.5 | 44.0 |
| | 0.0028 | 4 | 78 | 124.7 | 26.4 | 39.2 |
| | 0.00035** | 4 | 80 | 99.5 | 33.5 | 41.8 |

*Standard paper case

**Aluminum foil laminated to both sides of kraft paper. All values are averaged for the number of items noted. Case dimentions: length 2.4 in., I.D. 1.26 in.; wall thickness 0.065 in.

As shown in the table, a substantial increase in flare efficiency was achieved in most instances by use of a laminated kraft paper-aluminum foil flare case. Optimum efficiency was obtained by use of cases having 0.0007 inch thick aluminum foil laminated to the kraft paper. Use of much heavier aluminum foil, e.g. 0.0028 inch thickness, produced less efficient flare cases, which suggests that diminishing returns by use of aluminum foil of substantially greater than 0.0007 inch thickness. Cases having 0.00035 inch thick aluminum foil laminated to both sides of the kraft paper, were also highly efficient, suggesting that the thickness of 0.0007 inch (0.00035 × 2) is close to the most efficient in this particular system. It was also noted that all flares with the laminated kraft paper-aluminum foil cases exhibited little flickering and burned with much more uniform light emission from start to end than the standard kraft paper case flares.

Flares prepared in similar manner to the foregoing, except that newsboard (paperboard made chiefly from repulped newspapers) was substituted for 60 lb. kraft paper, were tested in another series of tests, and were found in each case to have an efficiency of 25 to 26 times $10^3$ candle sec./gm., but still higher than that of corresponding flares made without the aluminum foil.

Although the surprisingly superior efficiency of the duo-material flare case is not fully understood, it appears to be largely due to the smooth disintegration of the case as it burns, which eliminates the light-obscuring chimneys noted in the standard cases. Also, it is surmised that due to the conductivity of the metal foil in the case, some preheating of the flare composition may occur, thereby promoting a more efficient burning of the composition.

In another series of tests flare cases were made in the manner described above except that a relatively noncombustible rubber-based adhesive was used in place of highly flammable DUCO cement in laminating the aluminum foil (aluminum foil of 0.00035 inch thickness was used in these tests) to the kraft paper. The cases were loaded as above with the aforesaid pyrotechnic composition and the flares were tested for luminous efficiency in the foregoing manner. The test results set forth in Table II show that the type of adhesive does not appear to have a significant effect on flare performance.

Table II

| Adhesive | No. Test Items | Composition Wt. Grams | Candlepower ($10^3$ Candles) | Burning Time (Sec.) | Efficiency $10^3$ Candle Sec./Gm. |
|---|---|---|---|---|---|
| Nitrocellulose Based | 4 | 70 | 81.8 | 29.5 | 34.4 |
| Rubber Based | 4 | 70 | 94.3 | 25.5 | 35.0 |

All values are averages for the number of items noted.

In view of the foregoing it is evident that the efficiency of a pyrotechnic flare, comprising a metallic fuel and a solid inorganic oxidizer contained in a conventional convolutely wound paper case, can be unexpectedly increased by replacing such case with a convolutely wound paper-metal foil laminate case.

As illustrated in part above, the luminous efficiency of the system depends upon the thickness and type of metal foil and paper employed, thickness of the case wall, case design, the particular pyrotechnic flare composition employed, etc., and these variables can be adjusted to provide the desired or optimum results. Kraft paper is the preferred paper material for use in the novel flare cases, and satisfactory results can be obtained by employing 10 to 250 lb. kraft paper, although the invention is not limited thereto.

The foregoing disclosure and drawings are merely illustrative of the principles of this invention and are not to be interpreted in a limiting sense. I wish it to be understood that I do not desire to be limited to exact details of construction shown and described for obvious modifications will occur to a person skilled in the art.

What is claimed is:

1. A flare comprising a tubular case containing a load of solid pyrotechnic composition comprising a finely divided magnesium fuel and sodium nitrate oxidizer, said case consisting essentially of convolutely wound kraft paper of from about 10 pounds to about 250 pounds weight bonded to aluminum foil of thickness between 0.00035 inch and about 0.0028 inch with an adhesive, said flare exhibiting substantially no chimney effect on burning.

2. The flare according to claim 1, wherein the case consists essentially of about 60 lb. kraft paper bonded to aluminum foil of about 0.0007 inch thickness.

3. The flare according to claim 2, wherein the pyrotechnic composition consists essentially of 49% Mg, atomized 30/50, 43% $NaNO_3$ and 8% polymerized polyester-styrene binder.

* * * * *